United States Patent [19]

Steiger et al.

[11] 4,181,583

[45] Jan. 1, 1980

[54] METHOD FOR HEATING ELECTROLYTIC CELL

[75] Inventors: Roger A. Steiger, Canal Fulton; Calvin B. Holden, Doylestown, both of Ohio

[73] Assignee: PPG Industries, Inc., Pittsburgh, Pa.

[21] Appl. No.: 966,836

[22] Filed: Dec. 6, 1978

[51] Int. Cl.[2] ..... C25C 3/06; C25C 3/16; C25C 3/26; C25C 3/34

[52] U.S. Cl. ..... 204/67; 204/64 R; 204/64 T; 204/65; 204/68; 204/70; 204/243 R

[58] Field of Search ..... 204/64 R, 64 T, 65, 204/67, 68, 70, 243 R, 243 M

[56] References Cited

U.S. PATENT DOCUMENTS

| | | | |
|---|---|---|---|
| 2,915,442 | 12/1959 | Lewis | 204/67 |
| 3,028,324 | 4/1962 | Ransley | 204/67 |
| 3,400,061 | 9/1968 | Lewis et al. | 204/67 |
| 3,960,696 | 1/1976 | Wittner | 204/243 R |
| 4,045,307 | 8/1977 | Turley | 204/243 M |
| 4,071,420 | 1/1978 | Foster et al. | 204/67 |

OTHER PUBLICATIONS

Mantell, Electrochemical Engineering (McGraw-Hill Book Co., Inc.) 4th ed. (1960) pp. 398-427.

*Primary Examiner*—Howard S. Williams
*Attorney, Agent, or Firm*—Irwin M. Stein

[57] ABSTRACT

A method is described for controllably heating an electrolytic cell used for the production of metal, e.g., aluminum, from a compound of the metal, e.g., alumina, to a desired temperature. The method is especially applicable to electrolytic cells which have refractory hard metal articles, e.g., Group 4b metal diboride articles, as internal elements of the cell. The electrolytic cell is brought to the desired temperature, e.g., substantially operating temperature, from ambient temperature by placing a resistance heater having a positive change in resistivity with temperature within the cell and passing current through the heater. Typically, a plurality of heaters is used. In one embodiment, the heaters are placed close to but spaced from the refractory hard metal articles. The heaters are usually connected in parallel to a source of electrical power and in a preferred embodiment are in electrical contact with the cathode and anode of the electrolytic cell. Sufficient current is passed through the resistance heaters to raise the temperature thereof to at least the desired temperature, thereby heating the cell to the desired temperature. The refractory hard metal articles can be part of the electrical circuit.

24 Claims, 10 Drawing Figures

FIG. 7
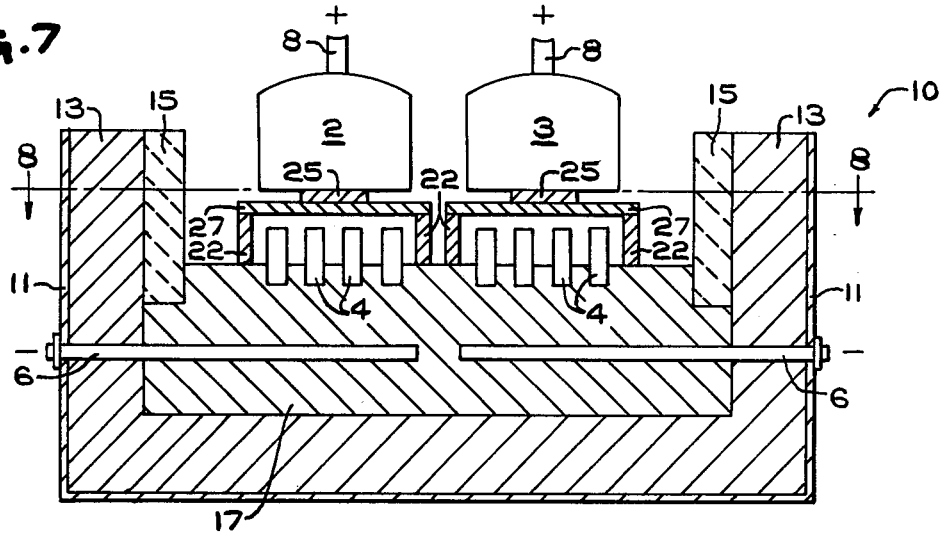
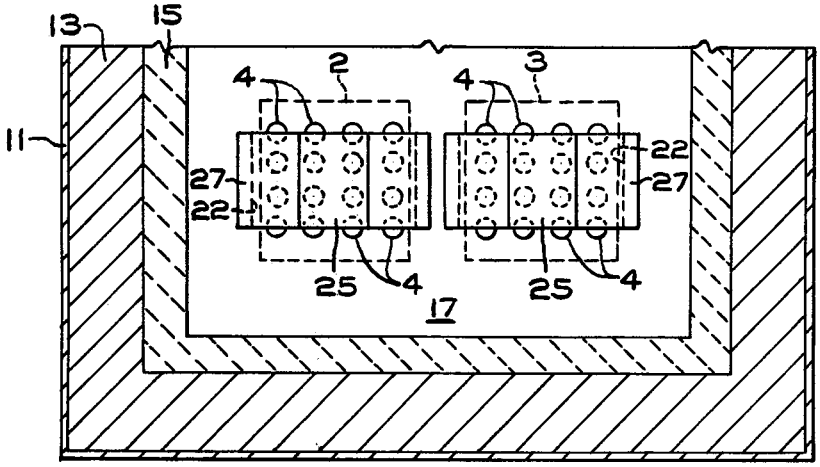
FIG. 8
FIG. 9
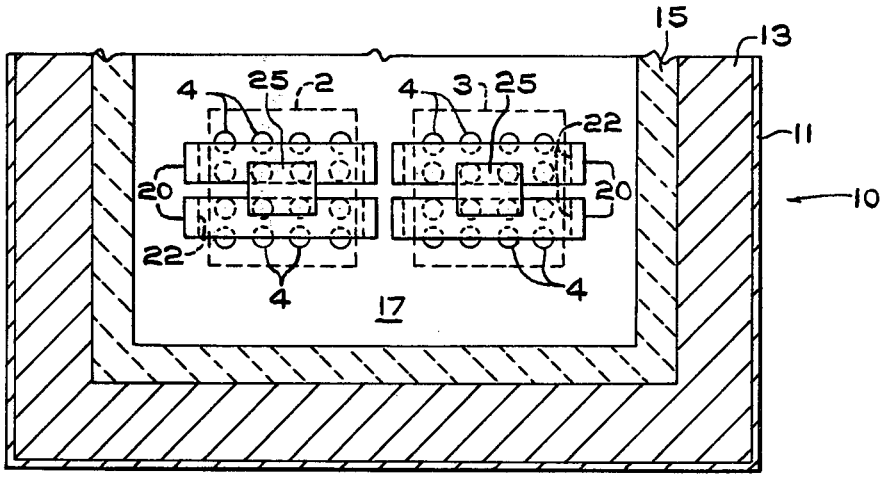

METHOD FOR HEATING ELECTROLYTIC CELL

DESCRIPTION OF THE INVENTION

In the electrolytic production of some metals, an electrolyzing current is passed from the anode to the cathode of an electrolytic cell through an electrolyte comprising a molten compound of the metal dissolved in a molten solvent. One of the more common metals produced by such a process is aluminum.

The electrolytic cell in common use today for the preparation of aluminum is of the classic Hall-Heroult design, i.e., the Hall cell. The cell utilizes carbon anodes and a carbon-lined bottom, which functions as part of the cathodic system. The carbon anodes extend into the cell from above and make contact with the electrolyte. Current collector bars, usually of steel, are embedded in the carbon bottom and complete the connection to the cathodic system. The electrolyte used typically consists primarily of molten cryolite in which is dissolved alumina and which contains other material such as fluorspar. Molten aluminum resulting from the reduction of alumina accumulates at the bottom of the electrolytic cell as a molten pool over the carbon-lined bottom and serves as a molten metal cathode.

However, electromagnetic wave effects and poor circulation cause the molten metal cathode to vary in thickness, which limits how far the inter-electrode spacing, i.e., the anode-cathode distance, can be reduced. Should the molten metal cathode touch the anode, a short circuit would occur.

The consumption of power due to resistance to current flow in the inter-electrode space is one of the largest losses experienced in operating a Hall cell. Reducing the inter-electrode spacing will result in significant savings of electric power, thereby improving the power efficiency of the cell.

Refractory hard metal (RHM) articles, e.g., titanium carbide and titanium diboride, have been suggested for use in the Hall cell as cathodic elements. These articles, when properly fabricated, are resistant to chemical attack by the electrolyte and their use permits operation of the Hall cell with a more narrow inter-electrode spacing than conventional Hall cells because they are wetted by the molten aluminum. See, for example, U.S. Pat. Nos. 3,028,324, 3,400,061, and 4,071,420.

Refractory hard metal articles, such as those prepared from titanium carbide or titanium diboride, are ceramic in nature and can crack or disintegrate if subjected to severe thermal stress, e.g., thermal shock. See, for example, U.S. Pat. No. 3,028,324, column 24, lines 68–72. The technique commonly in use today for starting a Hall cell, i.e., bringing the cell from ambient to operating temperature, e.g., about 950°–1000° C. includes lowering the anode of the cell onto the cathode, e.g., the cell bottom, which is generally covered with a layer of coke, and then turning on the electrolyzing current. The heat generated by the electrical contact resistance between the anode and cathode and the resistance of the coke is sufficient to bring the cell to operating temperature.

If the aforesaid technique for starting a Hall cell is used with RHM cathodic articles, there is a high likelihood of producing excessively high hot zones in the RHM articles due to non-uniform electrical contact of the articles with the anode and/or non-uniform contact between the RHM article and the cell bottom. Such hot zones cause high thermal gradients that lead to objectionable thermal stress in the article which can result in thermal-shock cracking of the article. Because of the large economic benefits that can result from the use of RHM articles, e.g., titanium diboride cathodic elements, in electrolytic cells, such as the Hall cell, for the production of aluminum, it has become desirable to develop a method for more gently and uniformly heating the cell and the RHM articles used therein from ambient to cell operating temperatures.

It has now been discovered that electrolytic cells for the production of metal, e.g., aluminum, and particularly electrolytic cells containing RHM articles such as titanium diboride cathodic elements, can be heated more gently and substantially uniformly to cell operating temperature without inducing objectionable thermal stress in the cell or in the internal elements thereof, e.g., RHM articles, thereby avoiding the consequences of uneven heating of different parts of the cell such as thermal-shock cracking of the RHM cathodic elements. The heat up is accomplished by placing one or more resistance heaters having a positive change in resistivity with temperature within the cell and passing current through the heater. The heater is proximate to but spaced from the internal elements of the cell to avoid producing hot zones in such elements. The heater can be supplied with power from a source separate from that used for the cell or it can be in electrical contact with the power source supplying the anode and cathode of the electrolytic cell. The heater can be designed to operate at the temperature desired by controlling its shape and dimensions. The aforesaid method of heating avoids rapid and extreme changes in temperature in the internal elements of the electrolytic cell. The cell and its parts are thereby heated controllably and substantially uniformly.

BRIEF DESCRIPTION OF THE DRAWINGS

In the accompanying drawings are illustrated several embodiments of the invention described herein as applied to aluminum reduction cells. In the drawings:

FIG. 7 is a horizontal view, partly in section, of a portion of an electrolytic cell for the production of aluminum illustrating a further embodiment of the invention;

FIG. 8 is a partial plan view of a portion of FIG. 7 showing the view taken along line 8—8; and FIGS. 9 and 10 are parital plan views of a portion of an electrolytic cell illustrating still further embodiments of the invention.

DETAILED DESCRIPTION OF THE INVENTION

The method described herein for heating an electrolytic cell and/or the internal elements thereof is applicable to electrolytic cells used for the electrolytic production of metal from a molten compound of the metal, e.g., a salt or oxide, or a compound of the metal dissolved in a molten solvent. The principal commercial electrolytic cell to which the present invention is applicable is the Hall-Heroult (Hall) cell for the manufacture of aluminum by the electrolysis of alumina. Other metals produced by electrolysis in a fused electrolyte bath include magnesium, sodium, lithium, beryllium, boron, cerium, columbium (niobium), molybdenum, zirconium, tantalum, titanium, thorium and uranium. See, Electrochemical Engineering, by C. L. Mantell, McGraw Hill Book Company, Inc., New York, 4th Ed. 1960, pp 398–427. Electrolytic cells used for the electrolytic production of the aforesaid metals can also be heated to their operating temperature or whatever temperature desired by the method described herein.

Figure 1:
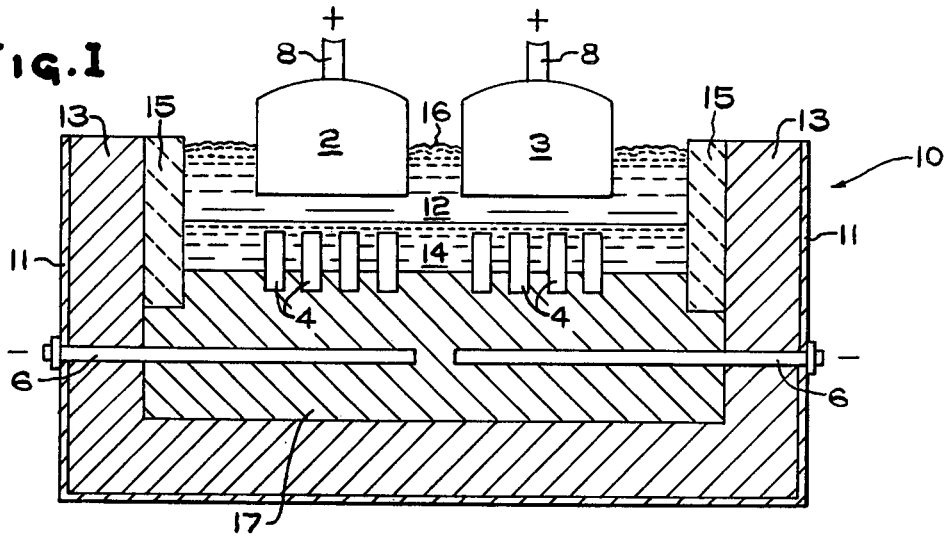
FIG. 1 is a horizontal view, partly in section, of a portion of an electrolytic cell for the production of aluminum containing cylindrical refractory hard metal cathodic elements; the cell is shown as it appears during operation with the pad of molten aluminum and electrolyte.

Referring now to FIG. 1, there is shown a horizontal view, partly in section of a portion of an electrolytic cell 10 for the production of aluminum containing cylindrical RHM cathodic elements 4 set into the floor 17 of the cell. The electrolytic cell comprises an outer metal shell 11, e.g., of steel, adjacent to which is disposed insulating lining 13 of a material such as alumina, bauxite, clay, magnesite, or aluminum silicate. Optionally disposed adjacent the insulating lining 13 is refractory wall 15. Such wall can be prepared from a refractory metal compound, such as silicon carbide brick, that is resistant to the conditions existing within the operating electrolytic cell. Inner wall 15 of the cell can also be carbon. Adjacent insulating lining 13 and at the bottom of the cell is floor 17. Commonly the floor is also fabricated from a carbon material, such as anthracite, which has a negative change in resistivity with temperature to minimize the voltage drop across the floor at operating temperature. Floor 17 must be electrically conductive to carry the current from molten metal aluminum pad 14 to current collector bars 6. However, if the current were to be removed from the cell by leads (not shown) connected electrically to metal pad 14, the floor could be fabricated from a relatively non-conductive material such as a suitable refractory, e.g., alumina, fused alumina, silicon carbide, silicon nitride, or other material resistant to the heat and molten substances with which it comes into contact.

The floor and walls of the cell generally define a chamber having an upper zone adapted to contain a body of solidified flux 16, a lower zone adapted to receive a pool of molten aluminum 14 and the RHM articles 4, and an intermediate zone adapted to contain a body or charge of molten electrolyte or flux 12. Disposed at least partially within the chamber and partially immersed in electrolyte layer 12 are anodes 2 and 3, which are usually of carbon, suspended from hangers 8, which can be of aluminum, iron, or copper. The hangers are connected to a bus bar (not shown) to connect the anode to the positive pole of the source of supply of electrolyzing current (not shown). As shown, the upper portion of each anode extends above the level of molten electrolyte 12 and through the crust 16 of solidified electrolyte overlying the same. As the anode is consumed during the operation of the cell it is progressively fed downwards in the well-known manner. The anodes can be of the "pre-baked" or the "self-baking" type, as is well known.

Disposed within carbon floor 17 are RHM articles 4. As shown, the RHM articles are cylindrical in shape and embedded or cemented in bores in the floor having the general shape of the article. To insure good electrical contact with the floor, graphite powder, graphite cement, or other conductive material can be used between the RHM article and floor. The RHM articles are arranged under each of the anodes and protrude out of the carbon floor into the molten aluminum pad 14. If desired, the RHM articles can extend into the electrolyte 12. The shape of the RHM article is not critical to the practice of the present invention and can be in the form of bricks, studs, cylinders (hollow or solid), plates of various geometric types, e.g., square, rectangle, etc. perforated plates, e.g., as described in U.S. Pat. No. 4,071,420.

Embedded in carbon floor 17 are current collector bars 6. Such bars serve to complete the electrical circuit by connection to a cathode bus system (not shown). The collector bar can be connected directly to the RHM cathodic elements 4, but usually it is not. Other means for withdrawing current from the cell can be employed also. However, in the arrangement shown, current passes serially from the anode bus system through anodes 2 and 3, electrolyte 12, molten aluminum pad 14 and/or RHM cathodic elements 4, and carbon base 17 to collector bars 6 and thence to the cathode bus system (not shown) which is connected to the cathode (negative) pole of the source of supply of electrolyzing current.

The term "refractory hard metals" has been used to specify a group of high melting hard substances which have metallic character, although, on the basis of chemical composition, they would be considered inorganic compounds. Typical representatives of those materials are the carbides, borides, and nitrides of the transition metals in Group 4*b*, 5*b* and 6*b* of the Periodic Table Of The Elements and the carbides and nitrides of boron, aluminum, and silicon. This designation of the Groups of the Periodic Table is based on the Periodic Table Of The Elements on the back cover of the Handbook of Chemistry and Physics, 45th Edition, The Chemical Rubber Publishing Company, 1964. A basic text describing the aforesaid refractory hard metals is *Refractory Hard Metals,* by Dr. Paul Schwarzkopf and Dr. Richard Kieffer, the MacMillan Company, New York, 1953. As used herein, the term "refractory hard metal" or "RHM" is intended to mean and include materials comprising the carbides, borides or nitrides of the aforesaid metals, mixtures of such carbides, borides and/or nitrides, and such transition metal carbides, borides or nitrides or such mixtures containing additionally minor amounts of other metals, e.g., aluminum and boron, metal carbides, metal borides, and/or metal nitrides, metal oxides, or carbon, which materials are resistant to the chemical and physical environment of the portion of the electrolytic cell in which they are used. Of particular interest for use in the electrolytic production of aluminum are the carbides, borides and nitrides of titanium and zirconium, especially the borides of titanium and zirconium, e.g., titanium diboride and zirconium diboride, and mixtures of titanium and/or zirconium diboride with other metal carbides, nitrides, oxides, free metals, borides, and carbon. See, for example, German patent publication OLS 25 23 423.

Exemplary refractory hard metals include: the borides, carbides and nitrides of titanium, zirconium, hafnium, vanadium, niobium, tantalum, chromium, molybdenum, and tungsten, and the carbides and nitrides of silicon, aluminum and boron. Compositions described in the United States patent literature, that can be used as RHM articles include: titanium diboride, titanium diboride-titanium carbide, titanium diboride-chromium diboride, titanium diboride-aluminum nitride, titanium diboride-aluminum nitride-boron nitride, titanium diboride-aluminum nitride-aluminum, titanium diboride-boron nitride-titanium nitride, titanium diboride-boron nitride, titanium diboride-boron nitride-aliuminum nitride, titanium diboride-titanium nitride, titanium diboride-boron, zirconium diboride-boron, zirconium diboride-cobalt boride, zirconium diboride-cobalt boride-boron, zirconium diboride-carbon-boron, zirconium diboride-titanium diboride, zirconium diboride-silicon carbide, zirconium diboride-silicon carbide-carbon, titanium diboride-titanium carbide-aluminum, and titanium diboride-chromium oxide-aluminum oxide. In the above compositions, titanium diboride, zirconium diboride and hafnium diboride can be interchanged where they are not used simultaneously.

Figure 2:
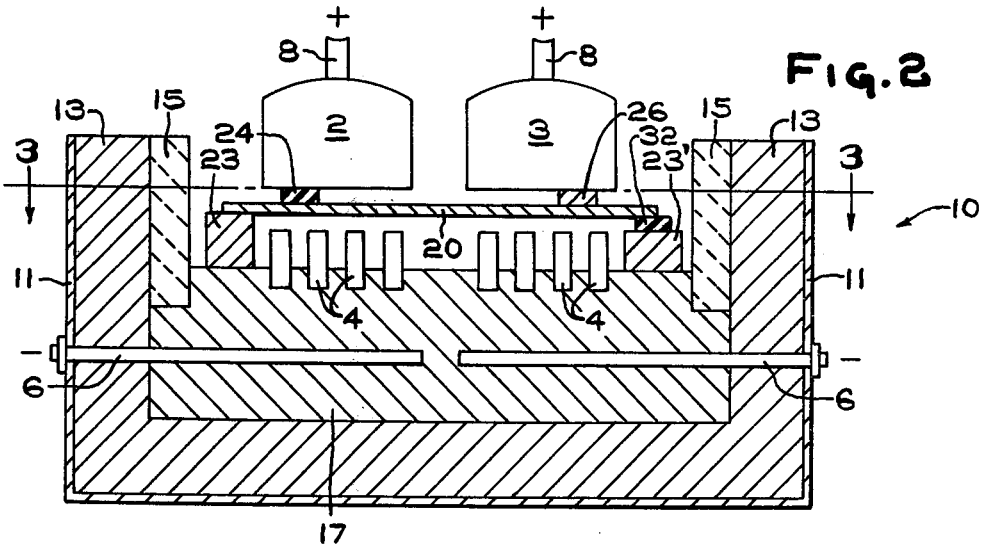
FIG. 2 is a view similar to that of FIG. 1 showing an embodiment of the invention, the electrolyte and molten aluminum pad being omitted.
Figure 3:
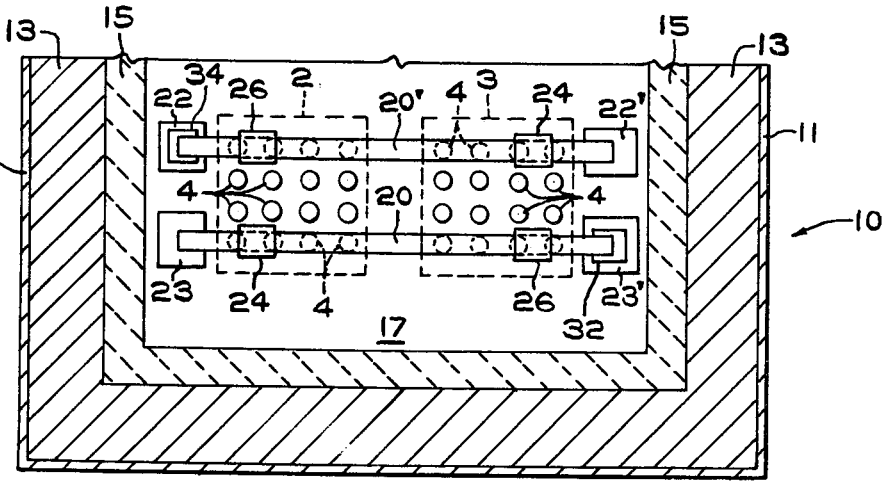
FIG. 3 is a partial plan view of FIG. 2 taken on the line 3—3 of FIG. 2.

Referring now to FIGS. 2 and 3 wherein like numbers indicate like parts, there is shown a view similar to that of FIG. 1 illustrating one embodiment of the invention. Solidified electrolyte 16, electrolyte 12 and molten aluminum pad 14 have been omitted. As shown in FIGS. 2 and 3, sixteen RHM cylindrical cathodic elements 4 are arrayed beneath each of anodes 2 and 3. Disposed between refractory lining 15 and the RHM cathodic elements are carbon blocks 22, 22', 23 and 23'. These carbon blocks rest upon carbon floor 17 and together with insulating blocks 32 and 34 project into the chamber of the cell further than the RHM cathodic elements to provide clearance between resistance heaters 20 and 20' and the RHM cathodic elements. Resistance heaters 20 and 20' should be spaced a sufficient distance from the side or top of RHM elements 4 to avoid imposing large thermal gradients through the RHM elements; but, the heaters should be close enough to heat the elements efficiently and uniformly by radiation and/or convection. In so heating the elements, the side walls and bottom of the cell will also be uniformly heated.

The distance the resistance heaters are spaced from the RHM cathodic elements can vary and will depend in great part to the temperature to which it is desired to heat the cell 10. The hotter the heaters, the greater the spacing required to avoid imposing objectionable thermal gradients within the RHM element. One skilled in the art can readily ascertain by trial and error the minimum spacing that can be tolerated by the RHM cathodic elements for any given resistance heater temperature. While heating of the RHM cathodic elements is discussed in more detail because some may be susceptible to thermal-shock cracking, heating of cell 10, particularly the internal elements thereof gradually and substantially uniform to operating temperature is also the result of the method described herein. By heating the cell in this manner, the RHM cathodic elements are heated gently and substantially uniformly, thereby avoiding thermal-shock cracking of such elements. The spacing of the resistant heaters from RHM articles in the cell as well as other thermal-shock sensitive parts of the cell is thus a consideration in providing the type of gradual heat-up obtained by the described method.

Generally, the resistance heater is spaced from about $\frac{3}{8}$ inch to about $1\frac{1}{2}$ inches from the RHM articles or other internal elements in the cell. Spacings of greater than $1\frac{1}{2}$ inches are of course acceptable since substantially all of the heat produced by the heaters is used to heat some portion of the cell, the top portion of the cell being covered to retain such heat. There will, of course, be heat lost to the surroundings from the bottom, top and sides of the cell due to convection and conduction. A spacing of at least about $\frac{1}{2}$ inch is recommended for heating titanium diboride articles in the cell to temperatures of about 800° C.–1200° C., e.g.,) 950° C.–1000° C.

Referring again to FIGS. 2 and 3, resistance heaters 20 and 20' in the form of rectangular bars extend almost the width of the cell and rest respectively upon support blocks, e.g., carbon support blocks, 23 and 23', and 22 and 22'. Two resistance heater bars 20 and 20' are shown for the thirty-two RHM elements (16 under each anode). Disposed on top of each resistance heater bar are electrical conducting blocks 26 and electrical insulating blocks 24. Insulating blocks 32 and 34 are placed on top of conducting blocks 23' and 22 respectively and below resistant heaters 20 and 20' respectively. This arrangement is depicted more clearly in FIG. 3 which also incorporates the outline of anodes 2 and 3.

In the method of the present invention, anodes 2 and 3 are lowered until they each contact conducting block 26 and insulating block 24 directly beneath it. Both the insulating and conducting blocks under each anode are naturally of the same height. Using heater 20 and anode 3 as exemplar, when current is permitted to flow through the anode, it passes from anode 3 through conducting block 26 to resistance heater 20 and thence through conducting support block 23 and floor 17 to the cathodic current collection system. Similarly, current flows from anode 2 through the conducting block 26, resistance heater 20' and conducting support block 22' to floor 17 and finally to the cathodic current collection system. Insulating blocks 24 beneath the anodes prevent current from flowing into the resistance heater upon which the insulating blocks 24 rest. Likewise, insulating blocks 32 and 34 prevent the flow of current from resistance heaters 20 and 20' into the support blocks upon which they rest. Thus, the current path in the resistance heaters is along the length of the heater and in one direction. Although FIG. 3 illustrates the use of insulating blocks 32 and 34 on top of supporting electrically conductive blocks 23' and 22 respectively, it is evident that these supporting blocks can be insulating in character and thus, for example, the function of blocks 32 and 23' can be combined into a single insulating block of equal height to supporting conducting blocks 23 and 22'. Resistance heaters 20 and 20' are thereby heated and they in turn heat the cell and its internal elements, including RHM cathodic elements 4.

The resistance heater bars are heated by the internal resistance of the bars to the flow of current through them, and they in turn radiate heat to the interior of the electrolytic cell. Further, that resistance to the flow of current, which is called contact resistance and which occurs at the interface of the various parts of the system, e.g., the anode, heater, bar, supporting and conducting blocks and the cell floor, also produces heat which is transferred to the internal elements of the cells by radiation and conduction. The heat produced by the internal resistance of the parts of the heating system, the aforesaid contact resistance and any hot zones that may occur despite precautions to avoid same, are all used to heat the electrolytic cell. This transfer of heat, principally by radiation, from the heaters and the contact resistance points to the interior of the electrolytic cell results in a gentle heating of the internal elements of the cell to the desired, e.g., operational temperature. The principal or major source of heat is derived however from the resistance heaters.

By interior (or internal elements) of the cell is meant those elements of the cell which are at the operational temperature of the cell during typical cell operation, e.g., the internal walls, floor and other internal parts of the cell. Naturally, the exterior of the cell and layers of material between the exterior and interior of the cell will become heated (by conduction and convection) from the heat present in the interior of the cell. However, insofar as the heat-up method described herein, it is necessary only to heat the internal elements to the desired temperature so that the cell can be charged with electrolyte, etc. and electrolysis can begin. Thereafter, the heat generated during electrolysis will maintain the cell at its operating temperature.

Resistance heaters 20 and 20' are fabricated from materials having a positive change in resistivity with temperature, i.e., the electrical resistance of the heater increases slightly with temperature. The aforesaid type of resistivity should be exhibited by the heater at least at the temperature to which it is desired the cell be heated and preferably at lower temperatures. In the case of electrolytic cells for the production of aluminum, it is preferred that the heater exhibit such resistivity at temperatures of at least about 800° C. Advantageously, the resistance heater has a positive change in resistivity with temperature at temperatures at which the heater appears visually to radiate heat, i.e., radiant heat from the heater is manifest by virtue of its appearance, e.g., the heater becomes red or white hot. Most preferably, the heater will exhibit a positive change in resistivity with temperature from ambient temperatures, e.g., room temperatures (20°–25° C.) to the desired temperatures; however, as in the case of a heater of graphitized petroleum coke, the heater can exhibit the necessary type of resistivity at the desired temperatures but not in the vicinity of room temperature. Graphitized petroleum coke exhibits a positive change in resistivity at temperatures about midway between ambient temperature and the desired operating temperature for an aluminum reduction cell, e.g., the Hall cell.

If there are multiple resistance heaters in a cell (as is usually the case) and if heaters have a negative change in resistivity with temperature, there is a high likelihood the cell and RHM articles therein will not be heated uniformly for the following reason: the anodes of electrolytic cells (such as those depicted in the attached figures) are commonly connected in parallel to the source of current. Further, the anodes are not usually made with a precision surface so that irregular electrical contact is made with conducting blocks placed beneath them. Current therefore will flow preferentially through whichever resistance heater has the better initial contact. This heater will increase in temperature and, due to its negative change in resistivity, will conduct a larger and larger share of the total cell current as it heats up. Thus, such a heater will get hotter as it conducts more current while other heaters will cool or remain cool if they had initial poor electrical contact. Consequently, there would soon appear a substantial imbalance in the temperature of the resistance heaters in the cell producing extreme thermal gradients within the cell. If the heaters are near RHM articles in the cell, the articles will reflect such thermal gradients in their temperature profile, thereby inducing objectionable thermal stress in the articles, which can result in thermal-shock cracking thereof. Further, the anodes carrying most of the current in that circumstance will overheat and crack.

Resistance heaters 20 and 20' are prepared from materials which have the capability of being heated to the temperature desired, e.g., the temperature required for electrolytic cell operation. For example, in the Hall cell, electrolysis is conducted typically at temperatures of between about 950° and 1000° C. Consequently, the resistance heaters used in the Hall cell should be capable of maintaining temperatures of at least 950° C., preferably up to 1500° C., for the time required to heat the cell to temperature. Thus, the resistance heaters should be of such mass that they will remain substantially intact for at least the period of use. Because of the high temperatures utilized and the presence of oxygen, the resistance heaters, especially graphite heaters, will tend to oxidize. Oxidation of the heaters can be lessened by shrouding them with a nonoxidizable environment, e.g., an inert gas. To further reduce oxidation, the top of the cell can be covered with a refractory cover, e.g., Fiberfrax ceramic insulation, which limits the amount of oxygen contacting the heaters. This also helps retain the heat produced by the heaters in the cell. As the heaters are oxidized, the products of oxidation fill the space around the heater. In the case of a graphite heater, decomposition products of the heating element, e.g., by disintegration, oxidation, etc., act as an inert shroud gas protecting the heater from continuous and substantial oxidation.

The resistance heater should also be of material that is sufficiently strong to support the weight of the anode which rests on it in certain embodiments. Although not critical, it is advantageous if the decomposition products of the heating element, e.g., by disintegration, oxidation, etc., not contaminate significantly the chamber in which they are used so that the initial metal produced in the cell will be substantially free of such contaminants. Further, the heater should be relatively insoluble in the electrolyte for the time required for heat-up in the embodiment in which the cell heat-up is performed in the presence of electrolyte.

The resistance heater can be designed readily by those skilled in the art. The heaters will operate either at the normal current of the electrolytic cell, at a known fraction of the normal current or at some known current provided by a separate source of power. The electrical resistivity of the heater is also a known factor. With these two known conditions, a skilled artisan can design the heater, i.e., its shape and dimensions, to provide a heater temperature which is sufficient to heat the electrolytic cell to the temperature desired for operation. While that temperature can be the operating temperature of the cell, it can be, of course, lower, thereby necessitating the use of auxiliary methods for completing the heat-up, e.g., charging hot electrolyte to the cell. Preferably, the temperature to which the heater is brought is higher than the operating temperature to reduce the heat-up period. In the case of the Hall cell, heater temperatures of from about 900° C. to 2000° C., preferably from about 1000° C. to about 1600° C., can be used. Where RHM articles are present in the cell, it is preferred that the cell be brought to operating temperature by the method described herein to avoid subjecting the articles to objectionable thermal stress.

Of particular utility for use as the resistance heater in the present invention is graphite, e.g., graphitized petroleum coke. This material has a negative change in resistivity up to about 400°-500° C. but, at higher temperatures exhibits a positive change in resistivity with temperature. Other carbon materials such as anthracite, petroleum coke, lamp black and graphitized lamp black, all exhibit a negative change in resistivity with temperature. See the *Carbon Products Handbook,* page 22, (1964) published by the Carbon Products Division of Union Carbide Corporation.

Although graphitized petroleum coke has a negative change in resistivity up to about 400°-500° C., it can still be used because when the change in resistivity becomes positive, the current flow through the resistance heaters becomes self-regulating until each of the heaters reaches the 400°-500° C. temperature level. Further, the temperature at which the resistivity changes from negative to positive is below the operating or desired temperature of the Hall cell (950°-1000° C.). Examples of other non-metallic and metallic materials that can be used as the resistance heater element other than graphitized petroleum coke include: molybdenum disilicide and resistance heaters fabricated from platinum, platinum-rhodium alloys, e.g., 87%Pt-13%Rh, 90%Pt-10%Rh, and 60%Pt-40%Rh, Nichrome alloys, and Kanthal alloy heating elements, e.g., 69%Fe, 23%Cr, 6%Al, and 2%Co.

As indicated above, the material from which the resistance heater is fabricated exhibits a positive change in resistivity with temperature at or less than the temperature to which the cell is heated. Typically, the resistivity of most materials does not change, from negative to positive or vice-versa within the temperature range ordinarily experienced by electrolytic cells for the production of metal, e.g., ambient to 2000° C. Graphitized petroleum coke is a material which exhibits such a change (negative to positive) is resistivity within the temperature range discussed. However, as long as the resistivity of the heater is positive with respect to temperature at the desired, e.g., operational, temperature, the heater can be used because of the self-regulating feature of materials having such property. Most advantageously, the resistivity of the heater would be and would remain positive with respect to temperature from ambient temperature to the desired temperature. However, as in the case of graphitized petroleum coke, if the resistivity of the heater can be and remain positive within a broad range of temperature up to and including the desired temperature, it is quite satisfactory.

Conducting and supporting blocks 22' and 23 and conducting blocks 26 are preferably also of a material that has a positive change in resistivity with temperature; however, it is not essential that they have that property. Advantageously they are of the same material, e.g., graphitized petroleum coke, as the resistance heater. When not of the same material as the resistance heater, it is preferred that supporting blocks 22' and 23 be fabricated from the identical material, and that conducting blocks 26 be fabricated from the identical material so that there is equalization of resistance to current flow between anode 2 and anode 3 to carbon floor 17. As shown in FIGS. 2 and 3, supporting blocks 22 and 23' are electrically conducting and have insulating blocks 32 and 34 between them and the resistance heater bar. In that embodiment, the material from which blocks 22 and 23' are prepared is not critical. It can be the same or different than blocks 22' and 23, and can be the same or different than insulating blocks 32 and 34.

It is preferred that the area of the face of blocks 26 and supporting blocks 23 and 22', i.e., the face contacting the resistance heater, each be at least twice the cross-sectional area as the resistance heater, e.g., the area represented by the end of the heater, to improve electrical conduction and to reduce the heat produced at the heater-block interface.

Insulating blocks 24, 32 and 34 are of material which is a good electrical insulator and relatively stable at the conditions of use, e.g., temperature. Examples of insulating materials that can be used include: silicon oxynitride, alumina, high alumina refractories, zirconia, boron nitride, and Fiberfrax ceramic (an alumina-silica refractory). In heating up a Hall cell, dense alumina can be used advantageously as the insulating blocks 24, 32 and 34. Once heat-up is concluded, the alumina can be left in the electrolyte to slowly dissolve and be electrolyzed.

To insure good electrical contact between the anodes, supporting and/or conducting blocks and the resistance heaters, it is contemplated that Grafoil graphite sheets, conducting cement, carbon powder, etc. be placed between the respective contacting surfaces of the anode, supporting and/or conducting block and resistance heater. Use of a conducting medium which can adjust its shape to compensate for geometric irregularities in the articles of construction insures good electrical contact and avoids the formation of hot spots due to poor electrical contact at any of the points of electrical contact.

While resistance heater bars 20 and 20' are shown in FIG. 3 centered above a line of RHM cathodic elements and resting on blocks situated on the cell floor beyond the perimeter of the anode, other embodiments or modifications of this illustration of the invention are contemplated. For example, in FIG. 3 there are shown under each anode four rows of four RHM elements. It is contemplated that the resistance heater bars 20 and 20' can be centered between the rows of RHM elements and supported by blocks situated within the rectangle defined by the outer RHM elements, i.e., within the perimeter which surrounds such elements. In a further embodiment, the heaters can be placed over the two center rows of RHM elements or between the rows of RHM elements.

The number of resistance heater bars beneath each anode can, of course, vary. The total area of heat radiating surface should be adequate to provide the heat necessary to gently and uniformly heat the interior of the cell in a reasonable time. Preferably, the face of the anode makes physical contact with only one conducting surface, e.g., a conducting block or a resistance heater. Use of one such contact point insures good electrical contact with the anode face. When two or more conducting contact points are used, there is the real likelihood that the rigidly held anode will make good contact with only one of the two or more contact points. Where, however, additional efforts are undertaken to insure good contact at all points, e.g., by the use of layers of Grafoil graphite at each point of contact or between the facing surfaces of the anode and those with which the anode makes contact, or by a specialized anode support designed to permit flexibility of movement, then more than one point of contact beneath the anode can be used. In the embodiment shown in FIGS. 2 and 3, each anode contacts only one conducting point, i.e., conducting block 26, the other contact point being the electrically insulating block 24.

Figure 4:
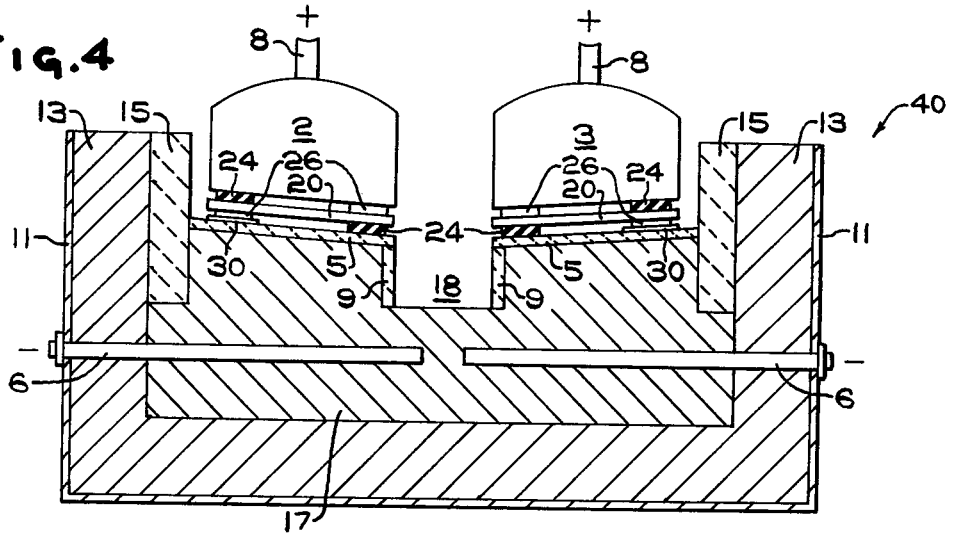
FIG. 4 is a horizontal view, partly in section, of a portion of an electrolytic cell for the production of aluminum having a center trench and refractory hard metal sloping cathode surface.

Referring now to FIG. 4, wherein like numbers indicate like parts, there is shown a horizontal view, partly in section, of a portion of an electrolytic cell 40 having a center trench or well 18 and refractory hard metal (RHM) sloping cathode surfaces 5. Such an electrolytic cell is described in U.S. Pat. No. 3,400,061. Refractory hard metal surface 9 also lines the sides of center trench 18. RHM surface 5 can be a continuous surface or it can be prepared with contiguous plates fastened in place on the floor of carbon bottom 17. The bottom of anodes 2 and 3 are shaped to conform with the angle of the sloping sides of RHM surface 5 and the floor of carbon bottom 17. Atop each sloping side of the RHM surface are positioned insulating blocks 24 and conducting blocks 26, which rest upon Grafoil graphite sheets 30 to insure good electrical contact. Resistance heater elements 20 are placed atop the insulating and conducting blocks adjacent to the RHM surface. Atop resistance heaters 20, there are shown insulator blocks 24 and conducting blocks 26 in positions diametrically opposite to those adjacent to the RHM surface.

In the method of the present invention, anodes 2 and 3 are lowered onto the blocks placed on top of resistance heaters 20 and current is allowed to pass through the anodes. In its passage to the cathode collecting bars 6, current passes through the conducting blocks 26, the resistance heaters 20, Grafoil graphite sheets 30, the refractory hard metal surfaces 5 and 9, and the carbon bottom 17. The embodiment of FIG. 4 illustrates the application of the present invention and method to a refractory hard metal surface other than bars, tubs, studs, etc. and to an embodiment in which the refractory hard metal is a substantially continuous surface across the floor of the cell. The embodiment of FIG. 4 is applicable also to a semi-continuous RHM cathode surface.

Figure 5:
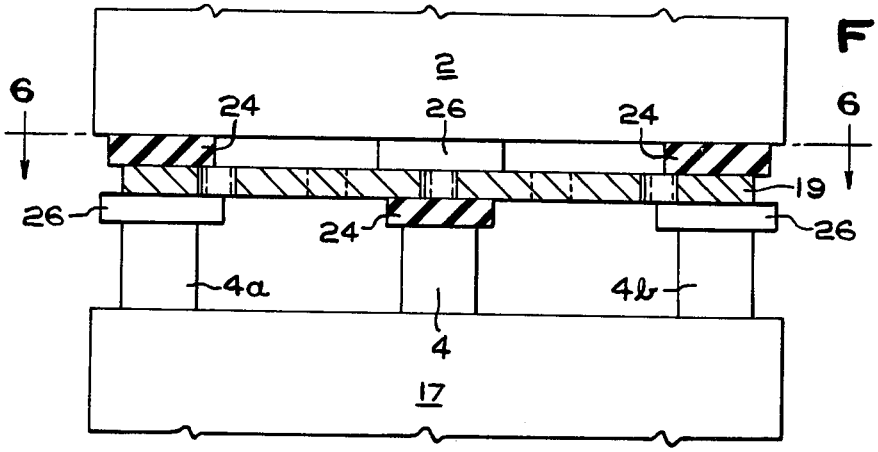
FIGS. 5 and 6 are diagrammatic illustrations of an embodiment of the invention wherein a slotted graphite plate is used as the resistance heater, FIG. 6 being a plan view of FIG. 5 taken along line 6—6 of FIG. 6.
Figure 6:
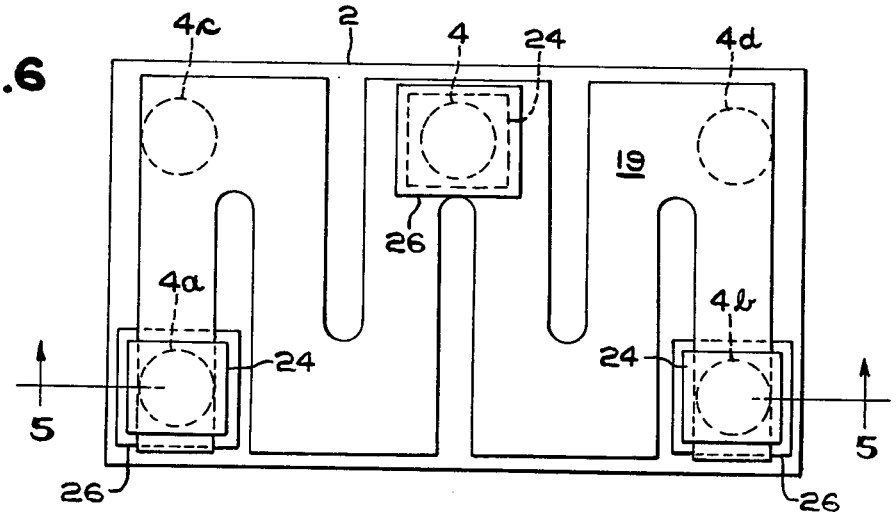

Referring to FIGS. 5 and 6, wherein like numerals indicate like parts, there is shown a diagrammatic illustration of an embodiment of the invention wherein the resistance heater is a slotted graphite plate. As shown in FIG. 5, anode 2 rests upon two insulating blocks 24 and a conducting block 26, which in turn rest upon slotted graphite plate 19 (which serves as the resistance heater). Between plate 19 and cylindrical RHM cathodic elements 4, 4*a*, 4*b*, 4*c* and 4*d*, there are positioned conducting blocks 26 (directly opposite insulating blocks 24), and insulating block 24 (directly opposite conducting block 26). Referring now to FIG. 6, when current is permitted to pass through anode 2, it passes through the adjacent (uppermost) conducting block 26 thence through the slotted graphite plate in two essentially equal serpentine paths to the two lower conducting blocks 26 adjacent to the RHM cathodic elements and then through RHM elements 4*a* and 4*b* into the carbon bottom 17.

In the embodiment shown in FIGS. 4, 5 and 6 the RHM cathodic elements or surface also conduct the current used to heat the cell to its desired temperature. The RHM cathodic element or surface is thereby heated partially by the heat produced as a result of its internal electrical resistance. Typically, as in the case of titanium diboride RHM cathodic elements or surface, the electrical resistivity thereof is relatively low and therefore the major or principal source of heat for such elements or surface is the radiation from the resistance heaters.

Referring now to FIGS. 7 and 8 wherein like numbers indicate like parts, there is shown a further embodiment of the present invention wherein resistance heaters 27 (in the shape of rectangular plates) are placed horizontally above and spaced from the RHM cathodic elements 4 and are supported by conducting blocks 22. Conducting blocks 25 are positioned on top of each resistance heater 27 and centered underneath anodes 2 and 3.

FIG. 9 is an embodiment of the apparatus shown in FIGS. 7 and 8 in which the rectangular resistance heater plates 27 of FIG. 8 are divided into rectangular resistance heater bars 20. The size of conducting blocks 25 has been reduced from that of conducting block 25 of FIG. 8. Each of the resistance heater bars 20 are supported by conducting blocks 22 at each end.

Figure 10:
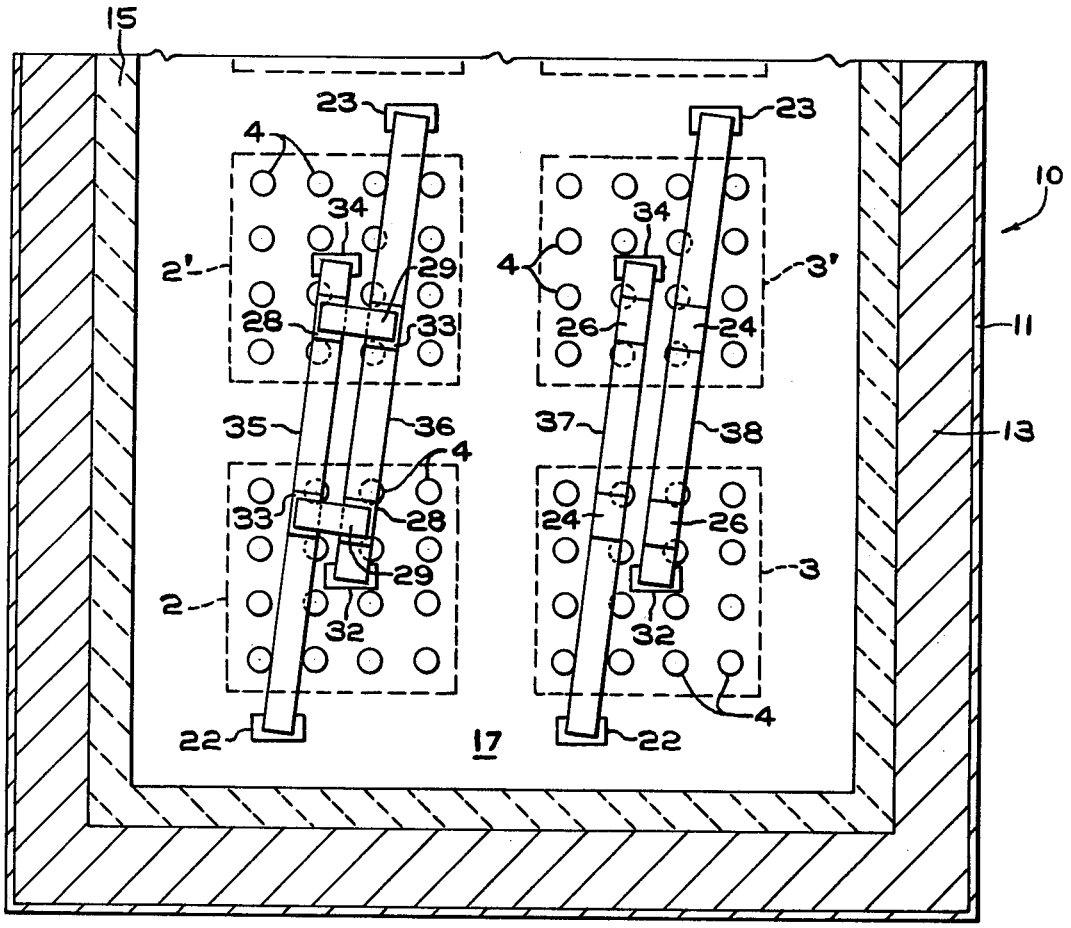

Referring now to FIG. 10, there is shown a partial plan view of a portion of an electrolytic cell illustrating a further embodiment of the present invention wherein the resistance heater bars are placed at an angle between adjacent groups of RHM cathodic elements. Further, in this embodiment, one and two anode contact points are illustrated. Resistance heater bars 35 and 36 and anodes 2 and 2′ illustrate the one contact point embodiment. There, heater bar 35 rests upon supporting conductor block 22 and supporting insulator block 34; and resistance heater bar 36 rests upon supporting conductor block 23 and supporting insulator block 32. Atop heater bars 35 and 36 are insulating blocks 33 and conducting blocks 28, the insulating and conducting blocks on the adjacent resistance heater bars being opposite one another. On top of such adjacent insulating and conducting blocks are conducting bars 29 which contact the anodes (single contact point) under which they are placed. When anode 2 is lowered to contact conducting bar 29 and current is permitted to pass through the cell, the current flows from anode 2 through conductor bar 29, conductor block 28, resistance heater 36 and supporting conductor block 23 to the cell bottom 17. A similar but opposite current path can be described for the current flowing from anode 2′.

Also shown in FIG. 10 are resistance heater bars 37 and 38, which illustrate the two contact point embodiment for anodes 3 and 3′. Current from anode 3 flows through conducting block 26, resistance heater bar 38 and supporting conductor block 23 to cell bottom 17. Insulating support block 32 prevents the current from passing directly to the floor 17 and insulator block 24 prevents current from anode 3′ from flowing into heater bar 38, such current flowing into heater bar 37 by means of its conducting block 26 and thence to cell bottom 17 through supporting conducting block 22.

As shown in FIG. 10 current is transmitted to the cell bottom 17 through supporting conductor blocks, e.g., blocks 22 and 23. However, it is contemplated that one or more of the RHM cathodic elements under the anode serve as a supporting and conducting element. This is accomplished by placing a conducting block on top of the RHM element(s) that is (are) to serve in that capacity of a thickness equal to the space between the bottom of the resistance bar and the top of the RHM element. In that embodiment, the ends of the resistance bars can be less offset, i.e., the ends of the resistance heaters outside the shadow of the anodes can be moved so that they are within the shadow of the respective anodes.

FIGS. 2-10 illustrate certain embodiments of the method described herein for heating an electrolytic cell for the production of metal to essentially the operating temperature of the cell without imposing objectionable thermal stresses on internal elements of the cell. In starting, for example, a Hall cell for the electrolytic production of aluminum, the interior of the cell is heated to about 950°-1000° C. by any of the embodiments described herein. The cell chamber is charged with molten aluminum and electrolyte, or electrolyte alone. Alternatively, the cell is charged before heat-up with powdered electrolyte, e.g., solid cryolite, which melts as the cell is heated to its operating temperature. When the cell is charged with electrolyte, the resistance heaters, conducting and insulating blocks, float to the top of the electrolyte if their densities (as is usually the case) are less than that of the electrolyte, and they are removed from the cell chamber. Such materials can be re-used if their condition warrants such use. Alternatively, graphite resistance heater bars and conducting blocks, and insulating blocks, e.g., dense alumina, can be left in the cell to be consumed ultimately. If left in the cell, these materials are moved aside so that the anode can be lowered to within the prescribed distance of the cathode. Electrolyzing current is supplied then to the electrodes of the cell and the cell is brought into production.

The present invention is also applicable to restarting electrolytic cells which have been shut down prematurely. The embodiments of the present invention represented by FIGS. 5 and 6 are particularly suitable for restarting such cells since the bottom of the cell would in all likelihood be filled with solidified metal and/or frozen electrolyte. In the embodiment represented by FIGS. 5 and 6, the RHM cathodic elements are part of the electrical heat-up circuit and conduct the current directly to the floor of the cell. Thus, in the case of a premature shut-down of the electrolytic cell in which the cell has cooled sufficiently to require a reheating of the cell contents and interior, the anode is lifted and the conducting blocks, insulating blocks and resistance heaters arranged in a manner described heretofore. The anode is lowered onto the conducting bars and the current turned on. When the resistance heaters have performed their function, they are removed and normal cell operation resumes.

The electrolyte used in the present invention is a molten compound of the metal being produced or a compound of the metal dissolved in a molten solvent. In the case of the electrolytic production of aluminum, a conventional electrolyte containing cryolite, alumina and additives can be employed. Cryolite, in the form of a double salt, is represented by the formula: $Na_3AlF_6$. Typically, the electrolyte contains about eight percent alumina initially and about four to nine percent calcium fluoride. Other additives include lithium fluoride and aluminum fluoride.

The refractory hard metal articles referred to above preferably possess a relatively low electrical resistivity, a low solubility in the molten metal being produced and in the molten electrolyte under cell operating conditions, is wettable by the molten metal, e.g., aluminum, and has good stability under conditions existing at the cathode of a reduction cell. As indicated, the preferred refractory hard metal materials, or at least that portion of the RHM article in contact with the molten metal, e.g., aluminum, and molten electrolyte, e.g., cryolite, are the borides of titanium, zirconium and hafnium, e.g., Group **4*b***. Particularly useful are the borides of titanium. Examples of RHM articles which are suitable for the practice of the methods of the present invention are described in U.S. Pat. Nos. 3,011,982 and 3,011,983, and German Patent Offenlegungsschrift No. 25 23 423.

In the latter publication, there is described a method for the manufacture of Group **4*b* metal borides by vapor phase reaction of the corresponding metal chloride, e.g., titanium tetrachloride, and boron trichloride utilizing a hydrogen plasma as a heat source. The Group 4*b*** metal boride powder thereby produced in submicron in size, e.g., has a surface area of between about 3 and 35 square meters/gram and can be consolidated into shapes by hot pressing and by cold pressing and sintering.

The present process is more particularly described in the following examples which are intended as illustrative only since numerous modifications and variations therein will be apparent to those skilled in the art.

EXAMPLE 1

Three titanium diboride cylinders that were open at both ends were arranged with their axes in a vertical direction on a carbon base as at the corners of an equilateral triangle. The tubes were prepared from carbon-containing titanium diboride powder of the type described in German Offenlegungsschrift No. 25 23 423, had densities of about 99 percent of the theoretical density for titanium diboride, and electrical resistivities of less than 10 microhm centimeters. The length to diameter (L/D) ratio of two tubes was about 1.1, such tubes having a wall thickness of about ½ inch. The remaining tube had a L/D ratio of 1.2 and a wall thickness of about ¼ inch. Each tube was fitted with two Chromel-Alumel thermocouples in insulating sheaths 1/16 inch O.D. to monitor temperature on opposite sides of the tube at about the center of its length. The thermocouples were placed so that the natural spring in the sheaths held the tip ends in contact with the surface of the RHM tube.

Three layers of 15 mil thick Grafoil flexible graphite sheet were placed on the top of each cylinder and four layers of such sheet were placed below the cylinder to provide uniform electrical contact at both the top and bottom surfaces. On top of the three layers of Grafoil graphite sheet on each cylinder was placed in sequence a 5×5×1 inch anthracite block, a 4×4×¼ inch graphite plate, two 2×2×¼ inch graphite plates and eight 1¼×1¼×¼ inch graphite plates. The graphite blocks were prepared from petroleum coke base graphite. The 2 inch and 4 inch graphite plates were made to distribute the weight and the heat to the anthracite block which functioned primarily to conduct uniformly the heat from the graphite heater stack to the titanium diboride tubes.

A second carbon block of about the same size and type as the carbon base was placed on top of the three stacks of graphite plates so that its weight was shared by the three stacks. The whole assembly was enclosed with a wall of 2½ inch thick Johns-Manville No. 2600 firebrick. The cracks between the top carbon block and the firebricks were stuffed with glass wool. The top and bottom carbon blocks were connected to a source of electrical current (the top being the positive pole) and about 2400 amperes at about 7.2 volts passed initially through the aforesaid arrangement. It was observed that after four minutes, the temperatures of the three stack heaters, which were read with an optical pyrometer, were not uniform. The temperatures of the second graphite plate from the top of the heater stacks being 1615° C., 1490° C., and 1960° C. However, after fifteen minutes, the self-leveling of the current by the positive-resistivity change with temperature of the graphite heater plates caused a temperature reduction in the hottest heater stack to give relatively uniform temperatures of 1550° C., 1435° C., and 1485° C.

The voltage drop between the top and bottom carbon blocks decreased to 4.9 volts after 25 minutes and remained at 4.9–5.1 volts for the remainder of the heating period. Power to the system was cut off after 2½ hours. At that time, on opposite sides temperatures of the ¼ inch-thick-wall tube were 976° C. and 970° C. The temperatures on opposite sides of one of the ½ inch-thick-wall tubes were 951° C. and 904° C.; while a temperature of the other ½-inch-thick wall tube was 944° C., the other thermocouple for this tube having failed at the end of 62 minutes. The temperatures measured have been tabulated in Table I.

TABLE 1

| Thermocouple Temperatures, °C. on $TiB_2$ Cylinders | | | | | | |
|---|---|---|---|---|---|---|
| | | | ½"-Wall Tubes | | | |
| | ¼"-Wall Tube | | Tube A | | Tube B | |
| Time (min.) | Side 1 | Side 2 | Side 1 | Side 2 | Side 1 | Side 2 |
| 1 | 100 | 86 | 50 | 52 | 50 | 40 |
| 10 | 506 | 480 | 367 | 332 | 364 | 340 |
| 20 | 598 | 590 | 518 | 468 | 520 | 476 |
| 30 | 614 | 621 | 584 | 530 | 572 | 532 |
| 62 | 728 | 740 | 690 | 628 | 697 | 668 |
| 90 | 852 | 862 | 812 | 754 | * | 800 |
| 120 | 926 | 941 | 901 | 854 | | 898 |
| 150 | 976 | 990 | 951 | 904 | | 944 |

*Thermocouple failed after 62 minutes.

The tubes were inspected visually after they had cooled. All appeared to be in good shape and to have suffered no thermal shock damage. The graphite heater stacks had partially oxidized. The smallest plates at the center of each stack of graphite plates were reduced from 1¼ inch to about ⅞ inch on each side.

The data of this Example shows that titanium diboride cylinders and their surroundings can be heated to greater than 900° C. without apparent damage with the use of graphite heaters having a positive change in resistivity with temperature, which heaters are electrically in parallel with each other. The graphite heaters functioned to heat the cylinders and surrounding cavity controllably and substantially uniformly. The Example further demonstrates that the cylinders can be the current conductors between the graphite heaters and the carbon base on which the cylinders rest.

EXAMPLE 2

Apparatus similar to that of FIGS. 5 and 6 was used to heat five titanium diboride cylinders similar to those used in Example 1. However, in this Example two conducting blocks were used adjacent to anode 2 and RHM cylinder 4 was used to conduct the current; whereas, in the embodiment depicted in FIGS. 5 and 6, only one conducting block was placed adjacent to anode 2 and RHM cylinders 4*a* and 4*b* were used to conduct the current to the carbon bottom 17. The cylinders had a L/D ratio of about 1.1 and a wall thickness of ½ inch. The cylinders 4, 4*a*, 4*b*, 4*c*, and 4*d* were placed on carbon block 17 in the manner shown in FIG. 6 and three layers of 15 mil Grafoil graphite sheet were placed on the top and bottom of each of the cylinders. A ¼-inch-thick petroleum coke base-graphite plate was placed on top of each of tubes 4*a* and 4*b* and a ¾-inch-thick insulating block 26 was placed on top of each of those ¼-inch-thick graphite blocks. A 1-inch thick petroleum coke base-graphite block 24 was placed on top of cylinder 4. The graphite heater serpentine plate 19 was placed on top of the aforesaid blocks and 1-inch-thick petroleum coke base-graphite blocks 24 were placed on top of the heater plate 19 above cylinders 4*a* and 4*b*. A ¾-inch-thick insulating block 26 was placed on top of the graphite heater plate above cylinder 4 and a ¼-inch-thick graphite plate placed on top of the insulating block for leveling. Carbon block 2 was placed on top of these blocks. The apparatus was encased by insulating brick to retain the heat generated.

Carbon blocks 2 and 17 were connected to a source of electrical current and about 1700 amperes at about 8.8 volts was passed through the system. The heater plate 19 had a total resistance of 0.02 ohms. Each leg of the two parallel electrical paths through which the current flowed had a resistance of about 0.01 ohms. After 2½ hours, the current was 1450 amperes, the temperature of the heater plate was about 1230° C., the temperature of the current-carrying cylinder 4 was about 1070° C., and the temperature of the two adjacent cylinders (4*c* and 4*d*) were about 980° C. and 1000° C. respectively. The temperature of cylinders 4*a* and 4*b* were observed to be about the same temperature as cylinders 4*c* and 4*d*.

EXAMPLE 3

Resistance heater bars were arranged in an electrolytic cell for the production of aluminum in a manner similar to that illustrated in FIGS. 2 and 3 with the following modifications: Resistance heater 20 was shortened so that block 23' rested underneath anode 3 and about midway between the two ends of the outline of anode 3 crossed by the heater bar. Similarly, resistance heater 20' was shortened so that block 22 rested underneath anode 2 and about midway between the ends of anode 2. The resistance heaters were petroleum coke base graphite bars 2"×3"×48". Grafoil graphite sheet was placed on top of each conductor block and Fiberfrax ceramic fiber was placed on top of each insulator block contacting the anode to provide uniform surface loading. The electrolytic cell contained six anodes, i.e., 3 sets of 2 anodes.

An array of RHM cathodic cylindrical elements was placed beneath each anode. There was a one inch space between the tops of the RHM elements and each resistance heater. The RHM cathodic elements arrayed beneath four of the anodes were titanium diboride cylinders similar to those described in Example 1. The L/D ratio of these cylinders was about 1.1 and each had a wall thickness of ½ inch. Cathodic elements of unknown composition and size were placed beneath the resistance heaters used under the other two anodes.

The anodes and cathodic collection system were connected to a power source and with the anodes in electrical contact with the conducting blocks resting on the resistance heaters, current in the amount of 4700 amperes at 7.5 volts was permitted to flow through the system to warm up the anodes. After about ½ hour at this condition, the power was increased to 13,500 amperes at 13.2 volts. Cold cryolite was added to the center channel of the cell about ¼ hour thereafter to prevent overheating the center of the cell. When a temperature of about 930° C. was reached in the center of the cell, the cryolite started to melt, which prevented the center of the cell from getting higher in temperature than the regions of the cell near the cell walls. At this time, the voltage had dropped to about 11.4 volts. Heating was continued for 1½ hours more, at which time the cell top opening was covered with Fiberfrax ceramic fiber to retain the heat generated from the heating system. When the conductor blocks supporting the resistance heaters were observed to be too hot, cold cryolite was added at these locations. About 3½ hours after the Fiberfrax ceramic fiber covering was placed on top of the cell, it was removed and the cell was filled with cold cryolite. Molten cryolite about 1 inch deep was observed to be present in the bottom of the cell. During the heating period, the power to the cell was increased gradually to a maximum of 19,800 amperes at 9.0 volts.

About 8 hours after current was applied to the system, the cell was observed to be at operating temperature and operational, i.e., electrolyzing cryolite. After one week of operation, inspection of the titanium diboride cylinders by a probe indicated that all were intact. This example shows that an electrolytic cell for the production of aluminum which contains RHM articles can be heated to operational temperature by the method of the present invention without imposing detrimental thermal stress on such articles.

EXAMPLE 4

Resistance heater bars were arranged in an electrolytic cell for the production of aluminum in the manner illustrated in FIG. 10; however, no RHM cathodic elements were present in the cell. The cell contained 20 anodes. The heater bars were of petroleum coke base graphite 1½"×4"×42". Current in the amount of 91,000 amperes at 14 volts was permitted to flow through the heating system. After 1¼ hours, the heaters were observed with an optical pyrometer to be 1400°–1500° C. Some hot spots were observed at the contact points of the conductor blocks supporting the heater bars. Fiberfrax ceramic fiber was then placed over the cell top openings to reduce air burning of the heaters.

Two hours after start-up, dry cryolite was added to the cell. Within 1¼ hours, molten bath had reached the bottom of the anodes.

This example demonstrates that the heat-up method described in this application can be used to heat an aluminum reduction cell which does not contain RHM articles to its operational temperature. It also shows that dry bath (cryolite) can be used to start such a cell. Although the heat-up was faster than desired and some hot spots were observed in the supporting conductor blocks due to contact resistance, the heat-up and start of electrolysis was deemed successful. The hot spots can be reduced by using Grafoil graphite sheet to reduce the contact resistance and by covering the lower conductor blocks with alumina powder. The heat-up period can be increased by moderating the current through the cell.

Although the present process has been described with reference to specific details of certain embodiments thereof, it is not intended that such details should be regarded as limitations upon the scope of the invention except as and to the extent that they are included in the accompanying claims.

We claim:

1. A method for controllably heating internal elements of an electrolytic cell for the production of metal to a desired temperature while avoiding objectionable thermal stress in such internal elements, which comprises placing a non-metallic resistance heater having a positive change in resistivity with temperature within said cell, connecting said heater to a source of electric current, passing sufficient current through the resistance heater to heat said heater to at least said desired electrolytic cell temperature, and continuing to pass current through said heater at least until the internal elements of the cell reach the desired temperature.

2. The method of claim 1 wherein the electrolytic cell is an electrolytic cell for the production of aluminum.

3. The method of claim 2 wherein the desired temperature is within the range of 800° C.–1200° C.

4. The method of claim 1 wherein the resistance heater is graphitized petroleum coke.

5. The method of claims 1, 2, 3, or 4 wherein the internal elements include refractory hard metal articles.

6. The method of claim 5 wherein the refractory hard metal articles are carbides, borides or nitrides of the transition metals of Groups **4*b*, 5*b*, and 6*b*** of the Periodic Chart of the Elements.

7. A method for controllably heating internal elements of an electrolytic cell for the production of metal to a desired temperature while avoiding objectionable thermal stresses in said internal elements, said electrolytic cell having a cathode and an anode and having refractory hard metal article among its internal elements, which comprises placing a resistance heater having a positive change in resistivity with temperature within said cell, said heater being proximate to but spaced from said refractory hard metal article and in electrical contact with the anode and cathode of the electrolytic cell, connecting said anode and cathode to a source of electric current, passing sufficient current through the resistance heater to heat it to at least said desired temperature, and continuing to pass current through said heater at least until the refractory hard metal article reaches the desired temperature.

8. The method of claim 7 wherein a plurality of resistance heaters are used and said heaters are electrically connected in parallel.

9. The method of claim 7 wherein the refractory hard metal articles are selected from the carbides and nitrides of boron, aluminum or silicon.

10. The method of claim 7 wherein the electrolytic cell is an electrolytic cell for the production of aluminum.

11. The method of claim 10 wherein the desired temperature is within the range of 800° C.–1200° C.

12. The method of claim 10 wherein the resistance heater is graphitized petroleum coke.

13. The method of claims 7, 10, or 12 wherein the refractory hard metal articles are carbides, borides or nitrides of the transition metals of Groups **4*b*, 5*b*, and 6*b*** of the Periodic Chart of the Elements.

14. The method of claim 13 wherein the refractory hard metal articles are selected from the borides of titanium or zirconium.

15. A method for controllably heating internal elements of an electrolytic cell for the production of aluminum to substantially the cell's operating temperature while avoiding objectionable thermal stress in said internal elements, said electrolytic cell having a cathode and an anode, and a refractory hard metal article among its internal elements, which comprises placing a graphitized petroleum coke resistance heater proximate to but spaced from said refractory hard metal article, said resistance heater being in electrical contact with said anode and cathode, connecting said anode and cathode to a source of electrical current, passing sufficient current through the resistance heater to heat it to at least said operating temperature, and continuing to pass current through said heater at least until the refractory hard metal article reaches to about the cell's operating temperature.

16. The method of claim 15 wherein the operating temperature is from about 950° C. to about 1000° C.

17. The method of claim 15 wherein cryolite is added to the cell, and current is passed through said cryolite, thereby electrolyzing the cryolite and forming aluminum metal.

18. The method of claim 15 wherein the refractory hard metal is titanium diboride.

19. The method of claim 18 wherein the resistance heater is spaced from about $\frac{3}{8}$ inch to about $1\frac{1}{2}$ inches from the titanium diboride article.

20. The method of claim 19 wherein the resistance heater is heated to temperatures higher than the cell operating temperature.

21. The method of claim 19 wherein the internal elements are heated principally by radiation from the resistance heater.

22. The method of claim 21 wherein a plurality of resistance heaters are used.

23. The method of claim 22 wherein the source of electric current is the same as that for the cell.

24. The method of claim 22 wherein the resistance heaters are connected electrically in parallel.

* * * * *